United States Patent [19]

Abdalah et al.

[11] Patent Number: 4,935,887

[45] Date of Patent: Jun. 19, 1990

[54] PROCESS AND ANALYSIS AND SIMULATION OF THE DISPLACEMENTS OF A HORSE

[76] Inventors: Ahmad Abdalah, Trebazan par Saint Wolf, 44350 Guerande; Pierre Durand, Le Pavillion des Saudieres, Vivy 46680; Claude Fortrain, Saint Leonard par, Saint-Claire 32380; Michel Daveine, 11 Rue Manin, 75019 Paris; Jean P. Granier, 39 rue de l'Illiade, 31500 Toulouse; Jean L. Jouffroy, 172 Rue de Grenelle, 75007 Paris; Yannick L. Guennic, 37, rue Claude Bernard, 35000 Rennes; Jean M. Yung, 2 Allee des Lilas, 77310 Ponthierry, all of France

[21] Appl. No.: 204,498

[22] Filed: Jun. 9, 1988

[30] Foreign Application Priority Data

Jun. 10, 1987 [FR] France ..... 87 08050

[51] Int. Cl.[5] ..... G09B 9/00

[52] U.S. Cl. ..... 364/578; 364/566; 364/576

[58] Field of Search ..... 364/561, 566, 576, 578; 73/514; 324/162

[56] References Cited

U.S. PATENT DOCUMENTS

| | | | |
|---|---|---|---|
| 4,573,131 | 2/1986 | Corbin | 364/566 |
| 4,703,445 | 10/1987 | Dassler | 364/561 |
| 4,736,312 | 4/1988 | Dassler et al. | 364/561 |
| 4,751,662 | 6/1988 | Crosbie | 364/578 |
| 4,763,287 | 8/1988 | Gerhaeuser et al. | 364/561 |
| 4,771,394 | 9/1988 | Cavanagh | 364/561 |

*Primary Examiner*—Parshotam S. Lall
*Assistant Examiner*—Christopher L. Makay
*Attorney, Agent, or Firm*—Darby & Darby

[57] ABSTRACT

Process of analysis of the complex displacements of a moving horse, consisting in: (a) placing on the horse (the saddle, for example) in real movement, measuring means (accelerometers, gyrometers, inertial control unit) by means of which one measures the speeds of linear displacement along the three axes, X, Y, Z and possibly of rotational displacement along these same axes; (b) establishing from these measurements the figurative curves, by repetitive pkeriods, of the variations of speed and position for the linear displacements and possibly for the rotational displacements; (c) analyzing these curves so as to determine its performances and its aptitudes for the different gaits, figures and jump, according to the different usages desired.

10 Claims, 2 Drawing Sheets

PROCESS AND ANALYSIS AND SIMULATION OF THE DISPLACEMENTS OF A HORSE

Figure 1:
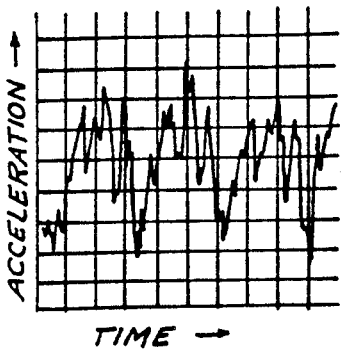

The present invention pertains to a process which permits analyzing separately the various parameters of displacement of a horse, for various objectives and notably for reproducing them on a simulator.

The techniques of simulation are known, in particular with respect to aircraft or tanks. However, until now the value at each instant of each of the parameters of the movement of the aircraft, so as to be able to reconstruct this movement as faithfully as possible, has always been calculated by means of mathematical models.

This method, using mathematical model, has proved to be difficult to use in the case of complex and relatively uncertain movements, for example, for a horse walking, trotting, galloping or clearing hurdles or doing figures. This is true because the mathematical laws governing the various parameters of the movement of a horse are very complex and practically impossible to determine. Even if such laws could be determined by successive approximations, the result would be theoretical movement of a standard horse, which would not be of great practical interest.

When a horse moves, the saddle moves at speeds varying fore-aft, from one side to the other, up and down, that is, along three axes—X (longitudinal), Y (sideways) and Z (vertical). At the same time there are rotations along these three axes—roll, pitch, yaw.

The process according to the present invention consists in:

a—placing measuring means (accelerometers, gyrometers, inertial control unit on an actual horse (for example, on the saddle) in real movement by means of which the individual speeds of linear motion are measured along the three axes X, Y, Z and the individual rotational motions about the same axes are measured versus time;

b—establishing by calculation the individual characteristics of a horse from these measurements, showing variations of speed and of position individually for the linear and rotational motions versus time.

Thus a precise analysis is obtained of the parameters of the real movement of a given horse.

Curve showing speed and position versus time can thus be established for the movements along the three axes X, Y, Z; for example, six of such curves, three for the linear motions and three for the rotational motions. The analysis of these curves permits an analysis of the most characteristic parameters of the motion of a given horse moving under given conditions.

It may also be of interest, besides the six parameters relating to the gait (i.e. to the motions of the horse), to analyze other parameters typical of the horse, such as the neck (withers) and/or poll (nape) motions. A study is then made of the movements of the neck, again along the same axes, namely the lowering or raising of the neck (pitch axis Y), sideways bending (yaw axis Z), rotation (roll axis X) as well as of the movements of the nape: direct bending (pitch), sideways bending (yaw), rotation of the head (roll).

Examination of these curves, which are then specific to a particular horse, as compared to those of other horse, enables determination of its performances and its aptitudes for various uses. The same examination enables detection of irregularities of gait or pathological defects.

This process, therefore, permits a much more rigorous and precise scientific analysis of the characteristics of the motions of a horse and of its aptitudes than those that have heretofore been obtained only by the simple observation of specialists.

According to the present invention, it is possible, after the preceding phases of data gathering and calculation to introduce the obtained curves in a mathematical model which determines, by summation of said curves, the position of the screw jacks of a simulation platform for reproducing the combined movements of the displacements of the horse.

Figure 6:
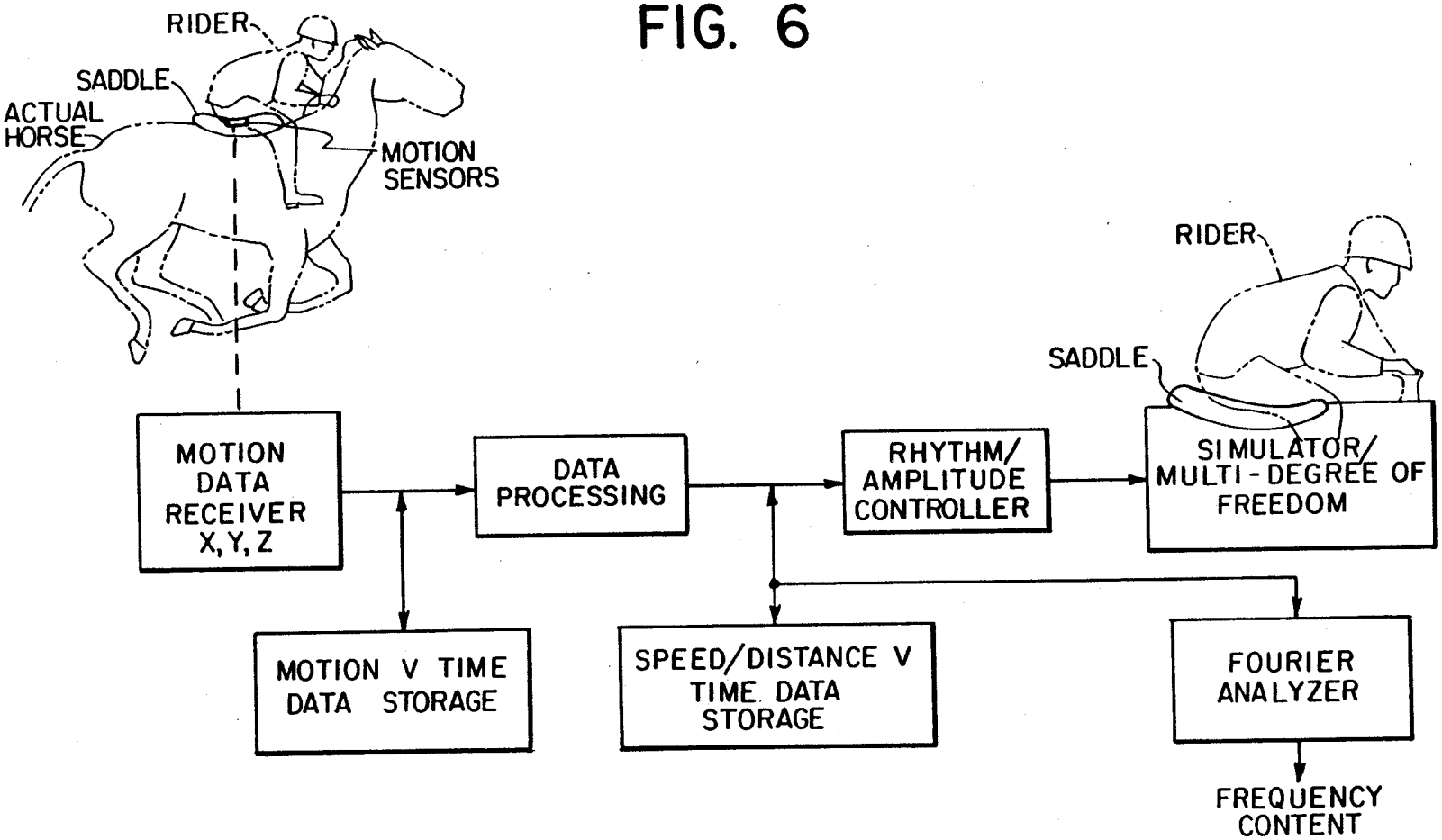

FIG. 6 is a functional block diagram of the process in accordance with the invention.

There are numerous more or less complex simulation devices in existence having a certain number of degrees of freedom and, depending on the complexity of the simulation that it is desired to obtain, one uses either some of the curves thus determined or all of them.

For example, for a simulation device with three degrees of freedom, able to reproduce only linear movements along the three axes X, Y, Z, only the curves of the linear displacements may be employed.

Also it is possible to employ a platform of six degrees of freedom of the type consisting of two inversed triangular platforms, the three summits of the lower triangle serving as base, and the three summits of the upper triangle being connected by six jacks, the geometric volume defined by the two triangles and the six jacks having eight triangular faces.

In this case the six curves characteristic of the gait of the horse are used, and by summation of these six curves the mathematical model determines the positions of the six jacks of the platform with six degrees of freedom.

Also only some of these six curves may be used. By way of example, while using the above-described platform with six degrees of freedom (and therefore with six jacks), only the three curves of linear displacements along the axes X, Y, Z are introduced into the mathematical model. Only translatory displacements of the upper triangle, without rotation are obtained. It was found, however, that a simulation of the horse's movement was obtained using three curves such that an experienced rider could recognize without hesitation not only the horse's gait, but also which is the characteristic foot of the gait (left-side gallop, right-side gallop, etc.).

A rider mounting a horse undergoes a secession of positive and negative accelerations several times per second depending on each gait of the horse.

According to a first embodiment of the method of the invention, three accelerometers disposed at right angles along the three axes X, Y, Z were placed on the back of a horse (either on the pommel of the saddle when there was a rider, or on a surcingle when there was none). Thus an aggregate of measurements was obtained, from which the curves of sped variations of linear displacement along the three axes were deduced.

Figure 2:
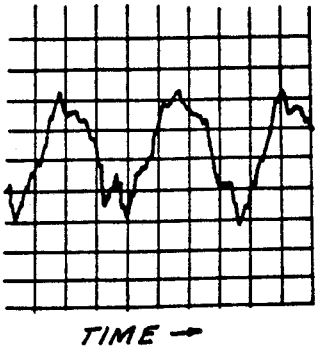
Figure 3:
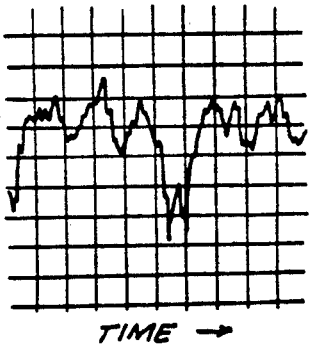

FIGS. 1, 2 and 3 represent three recordings along the vertical axis Z, in walking (FIG. 1), trotting (FIG. 2) and galloping (FIG. 3). These three records show the development in time (1/25 second) of the acceleration measured in 1/20 G for FIGS. 2 and 3 and at 1/100 G for FIG. 1. Examination of these figures shows that the signals are very readable and are characteristic of each gait; for example, the walk (FIG. 1) includes three positive and negative peaks for each half-stride. Processing of these data then leads to an integration of acceleration versus time which permits calculating the speed (around the middle position) and a second integration of speed versus time to determine displacements. An analysis of the data by Fourier series permits distinguishing, in this periodical phenomenon, the fundamental frequencies and the harmonics. Hence, original curves are reduced to an equivalent superposition of sinusoidal phenomena.

Figure 4:
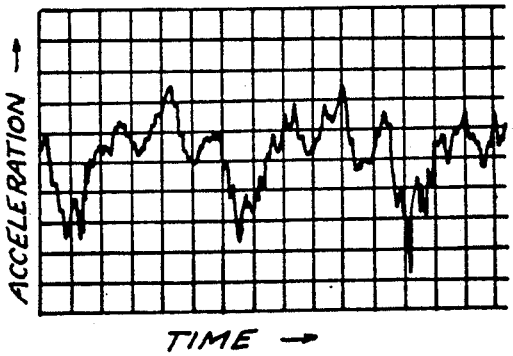
Figure 5:
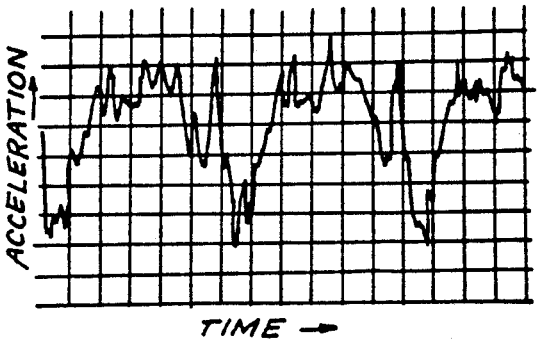

FIGS. 4 and 5 show the recording along the Z axis of two different horses, FIG. 4 (which corresponds to FIG. 3) being that of a horse A and FIG. 5 that of a horse B. Examination of these curves shows that while both are typical of gallop, the two horses are very different.

According to a second embodiment of the method of the invention, an inertial control unit was placed on the back of the horse, this time without rider. Thus it was possible to obtain simultaneously the measurements of accelerations and speed variations in linear displacement and in rotation along the three axes as well as the trajectory followed by the horse.

The process according to the invention consists also in modifying at will one or the other of these curves so that the movement of the platform of the simulator can be modified at will.

For example, the curves corresponding to the linear displacements of the walk, those corresponding to the trot, those corresponding to the gallop, and those corresponding to the jump having been placed in memory in a computer. The curves of the displacements along the X axis for the gallop and the jump were made to appear end to end on a screen and then they were joined together consecutively. The same was done for the curves along the Y axis and the Z axis; thus a simulation of the movement of a horse was obtained as if it performs a jump starting from the gait of a gallop In the same manner, the movement of a horse performing a jump from the trot could he simulated.

As a result of this process, therefore, the curves representative of the various parameters of movement of the horse and hence the resultant simulation of the movement can be modified at will, which offers considerable advantages.

Thus, a horse's trot includes about 130 beats per minute, which is physically rather difficult to endure notably for an adult (except of course for a trained rider). Owing to the process according to the invention, it is possible to simulate a comfortable trot of 60 beats per minute and to progressively increase it to 130 as the rider progresses. Obviously this is of great interest for the training and safety of the rider.

Also, one can increase the amplitude and reduce the rhythm, which enables the rider to better perceive the characteristic movement of the gait.

As to the particular problem of the obstacle jump, it is evident that for reasons of health one is obliged to limit the number of jumps that a horse is made to execute during a training session. On the other hand, if the rider wants to make 90 jumps (for example) in a work session for training himself—to appraise the optimum point of beat as a function of an obstacle or of a track, to appraise the useful length of a track, to recreate difficult situations, he can do so on the simulator.

Also, a rider's endurance can thus be developed.

This process of modifying the actual data is particularly useful for the rehabilitation by horseback riding of the physically handicapped and movement-impaired. By reducing rhythm and amplitude, better adaption to the difficulties posed by horseback riding becomes possible. Likewise, it may be very beneficial to let the medical personnel understand such or such a sensation by breakdown, deceleration or increase of the amplitude.

Owing to this process it is possible for a given horse to register phenomena of pathology of gait, and therefore to contribute to the early detection and identification of irregularities and lameness. Or further, after a phase of systematic analysis of the recordings of the gaits of horses performing in competition, to define the ideal profile of a race horse, for the various disciplines of horsemanship.

It turns out that reproduction of the rider's sensations by a simulator may involve an alteration of certain parameters either in amplitude or in rhythm. This can be remedied with the process according to the invention since each of the curves can be modified at will.

In the various examples, the various gaits (walk, trot, gallop) have been referred to; the invention is applicable not only to straight-line displacements but also to the cases of the figures.

In the example given before, the case was described where the modifications of the curves derived from the recordings were made by linking after visualization. By means of several cursors, also the rhythm or the amplitudes can be acted upon.

According to the present invention, one arranges on the simulator signal generators which act on the development of the simulation., Thus, for example, pressure pickups are placed at the level of the rider's knees and under the saddle so that when the rider presses his knees or jostles his seat, this acts on the development of the curves in the control module of the simulator (more or less fast depending on the pressure). Pickups are placed also on the bit, so that when the rider exerts a pull on the reins this acts on the development of the curves in the control module, and obviously the two signals can be superposed. It is thus possible for the rider to have an action on the development of the simulation which is no longer only passive but interactive.

We claim:

1. A method of analysis of complex motions of a living, moving horse in relation to three mutually perpendicular axes, comprising the steps:

(a) placing measuring means on said horse for sensing movement in relation to said axes, respectively, said measuring means being adapted to sense at least linear motions relative to said axes;

(b) having said horse perform in selected motional events and motional usages;

(c) recording the output data from said respective measuring means versus time during performance of said events and usage;

(d) processing for each said axis said motion data into at least one of distance versus time characteristics and velocity versus time characteristics for said horse, respectively for said selected events and usages, said distance and velocity characteristics being calculated relative to selected reference values;

(e) providing a motion simulator capable of producing at lest linear motions in relation to three mutually perpendicular axes; and (f) inputting at least one of said distance and velocity characteristics to said simulator in relation to elapsed time and in corresponding relationship of measuring means axis to simulator axis, said simulator reproducing the motion of said horse by simultaneous, synchronized response corresponding to the data inputted for said simulator axes.

2. A method as claimed in claim 1, further comprising the steps:

fitting said simulator with means for mounting a person in a horse-riding posture, said means for mounting having said reproduced horse motion transmitted thereto;

mounting a person on said simulator in said posture using said means for mounting;

3. A method as claimed in claim 2 and further comprising the step:

placing signal generators on said simulator for actuation by said person, actuation of said signal generators by said person affecting at lesat one of the amplitude and rhythm of at least a portion of said data inputted to said simulator.

4. A method as claimed in claim 2, and further comprising the step:

selectively varying at least one of the rhythm and amplitude of said data inputted to said simulator.

5. A method as claimed in claim 1, further comprising the step:

selectively varying at least one of the rhythm and amplitude of said data inputted to said simulator.

6. A method as claimed in claim 1, wherein said data inputted to said simulator is a synthesized sequence of data, said sequence being comprised of at least one of entire prerecorded data and portions of prerecorded data of said selected motional events and motional usages.

7. A method as claimed in claim 1, wherein said measuring means is adapted to sense linear horse motions along said three mutually perpendicular axes and rotational horse motions about said axes, and said motion simulator is capable of producing linear motions and rotational motions in relation to said three mutually perpendicular simulator axes.

8. A method as claimed in claim 1, wherein said measuring means on said horse include accelerometers sensing along said three axes, and said data processing includes first integration of said acceleration data versus time to produce said velocity versus time characteristics, and second integration to produce said distance versus time characteristics.

9. A method as claimed in claim 1, wherein said measuring means include an inertial control unit, said control unit directly giving curves indicating variations of speed and position versus time.

10. A method of analysis of complex motions of a living, moving horse in relation to three mutually perpendicular axes, comprising the steps:

(a) placing measuring means on said horse for sensing movement in relation to said axes, respectively, said measuring means being adapted to sense at least linear motions relative to said axes;

(b) having said horse perform in selected motional events and motional usages;

(c) recording the output data from said respective measuring means versus time during performance of said events and usage;

(d) processing for each said axis said motion data into at least one of distance versus time characteristics and velocity versus time characteristics for said horse, respectively for said selected events and usages, said distance and velocity characteristics being calculated relative to selected reference values;

(e) performing an analysis by Fourier series on at least one of said measured data and said processed data to determine the fundamental and harmonic sinusoidal frequencies comprising said horses characteristics in motional events and motional usages; and (f) comparing the frequency characteristics of said horse's motions against frequency characteristics of other horse in performance of the same motional events and usages.

* * * * *